United States Patent [19]

Powell et al.

[11] 4,453,346

[45] Jun. 12, 1984

[54] ADJUSTABLE WALL JAMB FOR SHOWER DOOR

[75] Inventors: David W. Powell, Union City; James W. Hodges, Palmersville, both of Tenn.

[73] Assignee: United States Gypsum Company, Chicago, Ill.

[21] Appl. No.: 381,108

[22] Filed: May 24, 1982

[51] Int. Cl.[3] ..... E06B 1/04; E05D 15/06

[52] U.S. Cl. ..... 49/404; 49/411; 49/413; 49/505; 52/217

[58] Field of Search ..... 52/217, 212; 49/505, 49/404, 411, 413

[56] References Cited

U.S. PATENT DOCUMENTS

| | | | |
|---|---|---|---|
| 1,724,186 | 8/1929 | Fox | 49/505 |
| 2,015,447 | 9/1935 | Esser | 52/217 |
| 2,284,074 | 5/1942 | Stahl | 52/217 |
| 2,595,506 | 5/1952 | Backman | 49/505 |
| 2,743,795 | 5/1956 | Taubman | 52/217 |
| 2,768,410 | 10/1956 | Woodard | 52/217 |
| 2,856,040 | 10/1958 | Dansereau | 49/411 X |

FOREIGN PATENT DOCUMENTS

| | | | |
|---|---|---|---|
| 1809532 | 8/1969 | Fed. Rep. of Germany | 52/217 |

*Primary Examiner*—Alfred C. Perham

*Attorney, Agent, or Firm*—Samuel Kurlandsky; Robert H. Robinson; Robert M. Didrick

[57] ABSTRACT

An adjustable wall jamb assembly for a shower door comprising a fixed wall jamb member adapted to be affixed to a wall, an adjustable block assembly comprising a block adapted to be affixed to the fixed wall jamb and having a threaded opening, and an adjustment screw having an external thread complementary with that of the adjustment block, the adjustment screw having an axial aperture and engaging means at one end for being engaged and rotated within the adjustment block, an adjustable jamb member adapted to slide over the fixed jamb member and to engage the end of the adjustment screw, and a screw disposed through an aperture in the adjustable jamb member, extending through the axial opening of the adjustable screw and being adapted to enter the wall on which the fixed jamb member is mounted.

10 Claims, 9 Drawing Figures

ADJUSTABLE WALL JAMB FOR SHOWER DOOR

BACKGROUND OF THE INVENTION

Shower door assemblies for mounting over the edge of a bathtub have become very popular. They are generally relatively inexpensive, relatively simple to mount, and provide a shower enclosure which is very suitable for use over extended periods of time. The doors generally are mounted within a metal frame and have rollers either at their bottom engaged in a lower track, or suspended from an upper track. The doors are easy to use and provide an excellent and convenient enclosure which can be used over an extended period of time.

In mounting shower door enclosures over a tub in older houses it has been found that often the walls are not plumb or perfectly perpendicular. Consequently when the jambs are installed and the door edges engage the jamb, there is not always a perfect fit, since an angular space may exist because the walls are not plumb. Many means have been utilized for adjusting for bathtub walls which are not plumb, but none has been completely satisfactory.

SUMMARY OF THE INVENTION

It is an object of the present invention to provide a means in the installation of shower doors over a bathtub to compensate for the fact that the walls may not be plumb.

It is a further object of the invention to provide an assembly which may be readily installed even by the "Do-it-yourself" homeowner.

It is a further object to provide an assembly for adjusting for walls which are not plumb, which assembly may be relatively easily and inexpensively fabricated.

Other objects and advantages of the invention will become apparent from a study of the present disclosure and appended drawings.

According to the invention an adjustable jamb assembly for shower doors is provided comprising a fixed wall jamb member, and an adjustable wall jamb member adapted to mount over the fixed wall jamb member and to slide in and out with respect thereto. An adjustable block assembly is provided comprising a block adapted to be affixed to the fixed wall jamb and having an axial aperture which is internally threaded, and an adjustment screw having external threads engageable with the internal threads of the block. The adjustment screw is provided with means such as flat screwdriver notches, Phillips screw socket, or Allen wrench socket to enable the end of the adjustment screw to be engaged and rotated by a tool such as a screwdriver or Allen wrench. The adjustable assembly is affixed to the fixed wall jamb member and positioned between the adjustable jamb member and the fixed jamb member and the adjustment screw rotated until the adjustable jamb is at a plumb angle. A flat head screw is then inserted through an aperture in the adjustable jamb member, through an axial aperture provided in the adjustment screw, through the fixed wall jamb member, and into the wall on which the wall jamb is mounted. This results in a jamb which is plumb, and against which the door edge fits perfectly. Once adjusted, the adjustment remains permanent until a further adjustment need be made.

DESCRIPTION OF THE PREFERRED EMBODIMENTS

Figure 1:
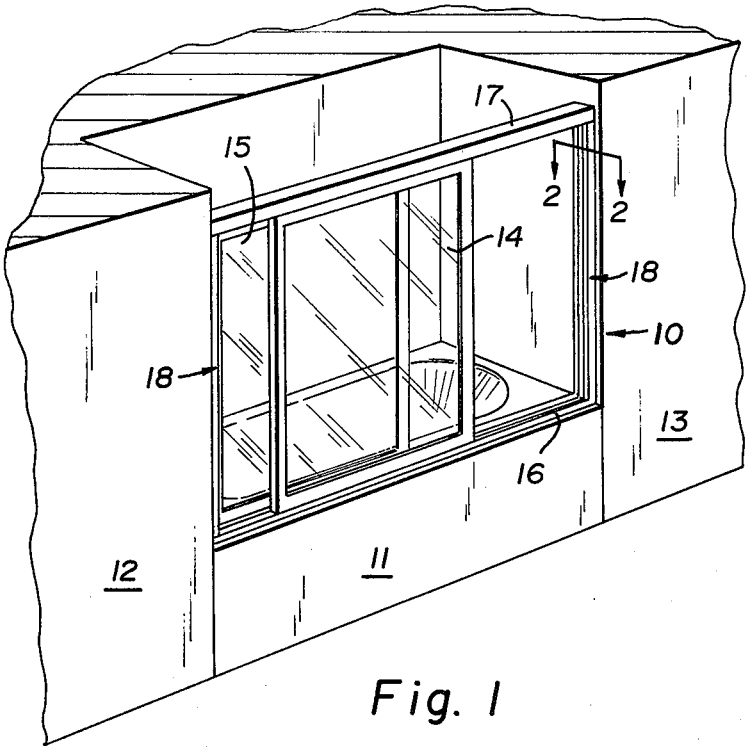
FIG. 1 is a perspective view of a shower door installation placed over a bathtub.

Referring to FIGS. 1–4, a shower door assembly 10 is shown mounted on a bathtub 11 positioned between two walls 12 and 13. The structure comprises a front door panel 14 and a rear door panel 15 mounted on a bottom track 16 (shown in FIG. 4) and a top track 17. Mounted against the walls are wall jamb assemblies 18, each comprised of a fixed wall jamb member 19 affixed to the walls 12 or 13 and an adjustable wall jamb member 20. Each fixed wall jamb member 19 is comprised of a web 21 having flanges 22 and 23 and a channel formed of internal flanges 24 and 25. The adjustable jamb member 20 comprises flanges 26 and 27 disposed over the flanges 22 and 23 of the fixed wall jamb member, and panels 28, 29 and 30 defining a recess 36 for receiving the end of a door.

Figure 9:
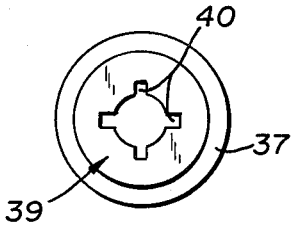
FIG. 9 is an end view of the structure shown in FIG. 8.

An adjustment block assembly is provided between the fixed and adjustable jamb members and comprises an adjustment block 31 having a shoulder 32. Lips 33 and 34 of the flanges are bent over the shoulder to maintain the adjustment block 31 slidably contained within the channel. The adjustment block 31 is provided with an internally threaded axial aperture 35. An adjustment screw 37 which is externally threaded is threadedly engaged in the threaded aperture of the adjustment block 31. The adjustment screw 37 is provided with an internally chamfered end 39 (shown in FIG. 9) communicating with the axial aperture 35 provided in the adjustment screw 37. The chamfered end 39 of the adjustment screw 37 is provided with tool engaging slots 40 to permit either a flat edge screwdriver, a Phillips screwdriver, or an Allen wrench to engage the adjustment screw 37 for rotating it within the adjustment block 31. An aperture 41 is provided in the panel 28 for having a screw extend therethrough and to engage the wall 13. The aperture 41 is countersunk to permit the flat head of a screw 42 to be mounted substantially flush with the external panel 28 of the adjustable jamb member 20.

Figure 2:
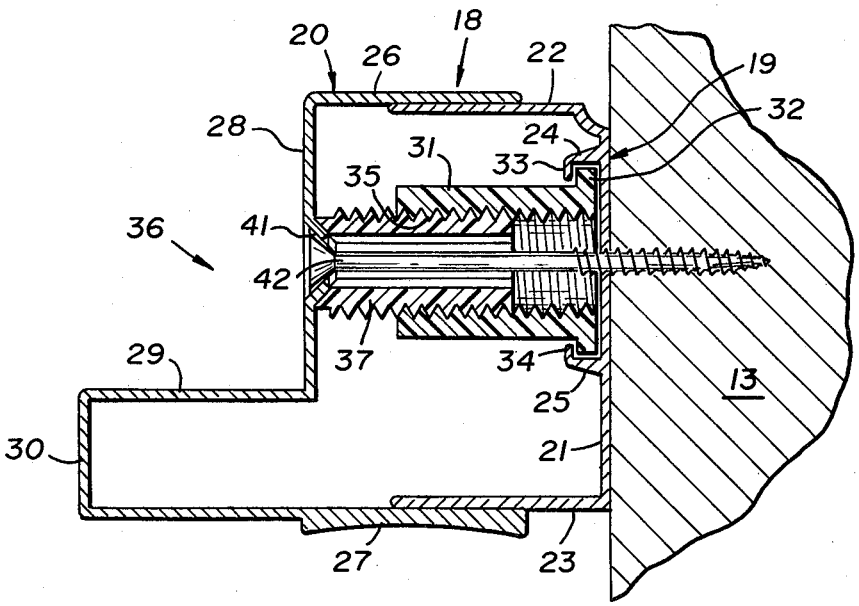
FIG. 2 is an enlarged fragmentary cross-sectional view taken at the line 2—2 of FIG. 1, looking in the direction of the arrows.
Figure 3:
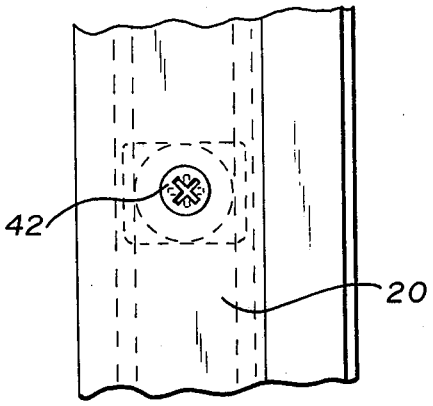
FIG. 3 is a fragmentary view of a portion of the adjustable wall jamb showing the means by which, after being properly adjusted, it is affixed to the wall.
Figure 4:
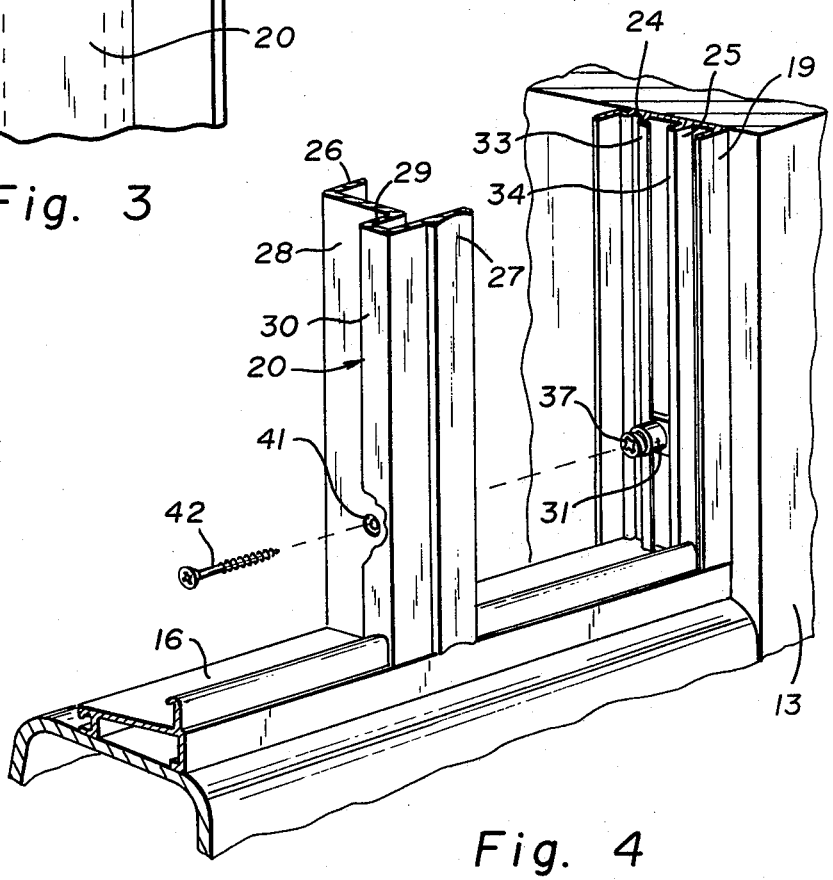
FIG. 4 is a fragmentary perspective view of portions of the fixed and adjustable wall jambs showing how the adjustable wall jamb, after adjustment, is affixed to the wall.
Figure 5:
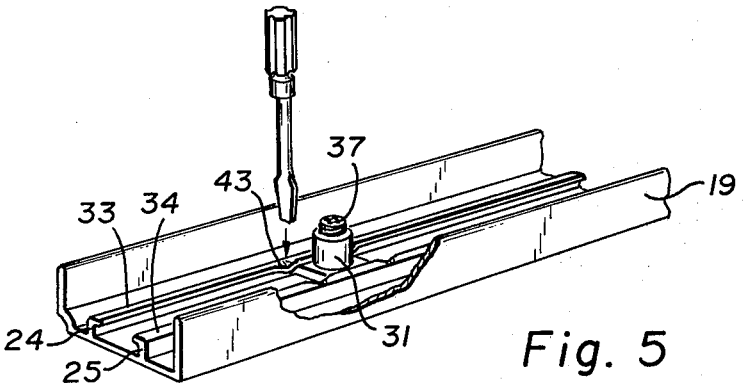
FIG. 5 is a fragmentary perspective view showing how the lip of the channel of the fixed wall jamb is depressed to maintain the adjustment block in place.
Figure 6:
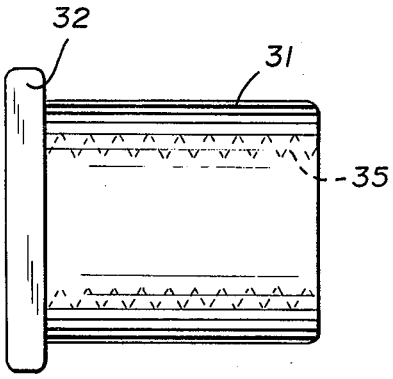
FIG. 6 is an elevational view of the adjustment block.
Figure 7:
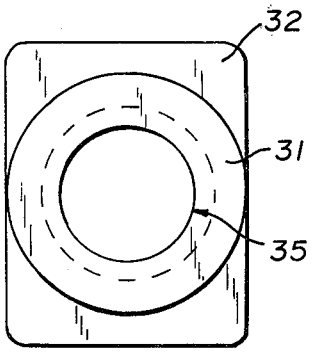
FIG. 7 is an end view of the adjustment block of FIG. 6.
Figure 8:
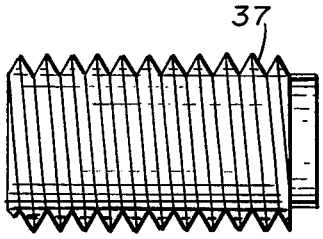
FIG. 8 is an elevational view of the adjustment screw.

In mounting the adjustable jamb assembly of the present invention, the jamb members are first cut to the proper length. The fixed wall jamb member 19 is then mounted against the wall 13 by means of screws. The adjustment block 31, as shown in FIG. 2 is contained within the flanges 24 and 25, and lips 33 and 34 of the channel which is an integral part of the fixed jamb wall member 19. The block is slid to its proper place, and the channel lips 33 and 34 are crimped to prevent further lateral movement of the block, as shown in FIG. 5. The adjustable jamb member 20 is then placed with its flanges enclosing the flanges of the fixed wall jamb member 19. A tool such as a screwdriver is then inserted through the hole 41 until it engages the slot 40 provided in the end of the adjustment screw 37. The adjustment screw is rotated until the adjustable jamb is flush with the edge of the door. Then the flat head screw 42 is inserted in the aperture 41, through the axial aperture 35, through the web 21 of the fixed wall jamb member 19, and into the wall 13.

Although only one adjustable wall jamb assembly and only one adjustable block assembly within the wall assembly has been discussed in detail, generally an adjustable jam assembly is used at each end of the tub, one for each adjustable sliding door. Further, two adjustable block assemblies are utilized for each adjustable door jamb assembly to provide a large degree of adjustment.

The adjustable jamb assembly of the present invention has a number of advantages. It is very easily assembled from extruded or rolled jamb member fittings. It is inexpensive and has a long life expectancy. Further, it may be readily installed even by a novice do-it-yourself workman. The fixed jamb member and the adjustable jamb member may be formed of a large number of different materials, such as steel, aluminum, or plastic. The adjustable block and screw assembly may be formed of a metal or preferably of a plastic material such as nylon. The jamb members may be readily formed by extrusion of a metal such as aluminum, and the adjustment block and adjustment may readily be formed by moulding. Although the structure has been shown and described in which the adjustment screw is inserted within the internal aperture of the adjustment block, the structure may be reversed and the adjustment screw may be inserted over the adjustment block, with the adjustment screw having an internal thread and the adjustment block an external thread.

It is to be understood that the invention is not to be limited to the exact details of construction or operation or materials shown and described, as obvious modifications and equivalents will be apparent to one skilled in the art.

Invention is claimed as follows:

1. An adjustable wall jamb assembly for a shower door, comprising a fixed wall jamb member adapted to be affixed to a wall, and an adjustable wall jamb member juxtaposed with respect to said fixed jamb member, an adjustable block assembly interposed between said fixed wall jamb member and said adjustable wall jamb member and comprising an adjustment block member adapted to be affixed at one end to said fixed wall jamb and having a threaded engagement means at the other end, and an adjustment screw having threaded engagement means complementary with that of said adjustment block, said adjustment screw having an axial aperture, the free end of said adjustment screw having means for being engaged by a tool for being rotated with respect to said adjustment block, said free end adapted to be in contact engagement with said adjustable wall jamb member thereby determining the spacing between said fixed and adjustable wall jamb members, said adjustable jamb member having an aperture therein at the area adapted to be in contact engagement with said adjustment screw, and a screw adapted to be disposed through the aperture in said adjustable jamb member, extending through the axial aperture of said adjustment screw, and being adapted to penetrate a wall of said fixed wall jamb member and to become affixed to the wall on which said fixed jamb member is adapted to be mounted, said fixed wall jamb member having a base web and flanges perpendicular with respect to and connected to the edges of said web, said adjustable wall jamb member being provided with flanges adapted to be disposed over the flanges of said fixed wall jamb member, said fixed wall jamb member being provided with a channel on its web having turned over lips, and said adjustment block member having a shoulder engaged within said channel and free to slide therein for adjustment until said lips are bent over to restrain said shoulder.

2. An adjustable wall jamb assembly according to claim 1, wherein said adjustable block member is provided with internal threads and said adjustment screw is provided with external threads complementary thereto.

3. An adjustable wall jamb assembly according to claim 2, wherein said adjustable wall jamb member is provided with a recess for receiving the edge of a door.

4. An adjustable wall jamb assembly according to claim 2, wherein the aperture of said adjustable wall jamb member is countersunk to permit the flat head of said screw to be mounted flush with the wall in which said aperture is placed.

5. An adjustable wall jamb assembly according to claim 2, having a pair of adjustable block assemblies.

6. A shower door assembly comprising in combination, a top track, a bottom track, front and rear door panels mounted on said tracks, and an adjustable wall jamb assembly mounted on a wall at each end of said tracks, each wall jamb assembly comprising, a fixed wall jamb member affixed to one of said walls, and an adjustable wall jamb member juxtaposed with respect to said fixed jamb member, two adjustable block assemblies interposed between said fixed wall jamb member and said adjustable wall jamb member, each block assembly comprising an adjustable block member affixed at one end to said fixed wall jamb and having a threaded engagement means at the other end, and an adjustment screw having threaded engagement means complementary with that of said adjustment block, said adjustment screw having an axial aperture, the free end of said adjustment screw having means for being engaged by a tool for being rotated with respect to said adjustment block member, said free end adapted to be in contact engagement with said adjustable wall jamb member thereby determining the spacing between said fixed and adjustable wall jamb members, said adjustable wall jamb member having an aperture therein at the area in contact with said adjustment screw, and a screw disposed through the aperture in said adjustable jamb member, extending through the axial aperture of said adjustment screw, and penetrating the wall of said fixed wall jamb member and affixed to the wall on which said fixed jamb member is mounted, said fixed wall jamb member having a base web and flanges perpendicular with respect to and connected to the edges of said web, said adjustable wall jamb member being provided with flanges adapted to be disposed over the flanges of said fixed wall jamb member, said fixed wall jamb member being provided with a channel on its web having turned over lips, and said adjustment block member having a shoulder engaged within said channel and free to slide therein for adjustment until said lips are bent over to restrain said shoulder.

7. A shower door assembly according to claim 6, wherein said adjustment block member is provided with internal threads and said adjustment screw is provided with external threads complementary thereto.

8. A shower door assembly according to claim 7, wherein the free end of said adjustment screw is provided with means for being engaged by a flat screwdriver.

9. A shower door assembly according to claim 7, wherein said adjustable wall jamb member is provided with a recess for receiving the edge of a door.

10. A shower door assembly according to claim 7, wherein the aperture of said adjustable wall jamb member is countersunk to permit the flat head of said screw to be mounted flush with the wall in which said aperture is placed.

* * * * *